US007146820B2

(12) United States Patent
Comerci et al.

(10) Patent No.: US 7,146,820 B2
(45) Date of Patent: Dec. 12, 2006

(54) ICE MAKER FOR REFRIGERATOR

(75) Inventors: Joseph D. Comerci, Elmhurst, IL (US); Timothy R. Gregori, Lockport, IL (US); Kirk R. Stevens, Lincoln, NE (US)

(73) Assignee: Molex Incorporated, Lisle, IL (US)

( * ) Notice: Subject to any disclaimer, the term of this patent is extended or adjusted under 35 U.S.C. 154(b) by 169 days.

(21) Appl. No.: 10/950,062

(22) Filed: Sep. 24, 2004

(65) Prior Publication Data

US 2006/0065005 A1 Mar. 30, 2006

(51) Int. Cl.
*F25C 5/08* (2006.01)

(52) U.S. Cl. ..... 62/137; 62/353

(58) Field of Classification Search ..... 62/135, 62/137, 351, 353; 403/359.1, 359.2, 359.3, 403/359.6

See application file for complete search history.

(56) References Cited

U.S. PATENT DOCUMENTS 3,712,076 A * 1/1973 Fox ..... 62/137
3,727,427 A * 4/1973 Eyman et al. ..... 62/353
4,142,378 A * 3/1979 Bright et al. ..... 62/135
5,261,248 A 11/1993 Willis et al. ..... 62/137
5,657,666 A * 8/1997 Tsuda et al. ..... 74/421 A
6,112,540 A * 9/2000 Serrels et al. ..... 62/351
6,637,217 B1 * 10/2003 Kim et al. ..... 62/125
6,743,868 B1 * 6/2004 Fournier et al. ..... 525/431
2004/0242334 A1 * 12/2004 Hamakita et al. ..... 464/7

* cited by examiner

*Primary Examiner*—William E. Tapolcai
(74) *Attorney, Agent, or Firm*—Stephen Z. Weiss

(57) ABSTRACT

An ice maker for a refrigerator/freezer having a control module for more reliably driving a rotatable ice ejector for removing ice bodies from a mold of the ice maker and for refilling mold cavities with water. The control module has an ice ejector drive with a drive coupling that includes a gear wheel and an ejector shaft section, both made of hard plastic material, preferably a polymide resin, for transmitting higher torque to the rotary ice ejector without failure of the plastic drive components. In one embodiment, a drive sleeve on the gear wheel and a drive shaft section have a spline coupling for more effectively distributing driving forces in the drive coupling. In another embodiment, a metallic collar is tightly positioned over the gear wheel sleeve for enhancing torque transmission in the drive coupling. The control module further is operable for refilling the ice maker mold cavities to a predetermined level during each cycle of operation notwithstanding slight alterations in positioning of water fill switching contact due to manufacturing tolerances or forces to which the ice maker is subjected during shipping, handling or installation.

20 Claims, 5 Drawing Sheets

ICE MAKER FOR REFRIGERATOR

FIELD OF THE INVENTION

The present invention relates generally to ice makers, and more particularly, to an improved drive and control module for ice makers used in refrigerators and the like.

BACKGROUND OF THE INVENTION

Ice makers are known for use in refrigerator/freezers, such as shown in U.S. Pat. No. 5,261,248, which include a mold in which water is frozen to form cube or other shaped ice bodies and a rotatable ice ejector having a plurality of radial ice ejector arms. A drive module is provided for rotating a shaft of the ejector, which includes a drive motor that drives the periphery of a gear wheel having an axial sleeve that receives and drives a vertical cam shaft, the rotation of which in turn rotates the ejector during an ejection cycle, as well as control rotation of an ice level sensing arm.

During the ejection cycle, ice bodies sometimes can become lodged between the ejector arms and the strippers so as to impede or interrupt rotation of the ejector. In an effort to overcome such obstructions, drive motors with increased torque have been employed for the ice ejector. Because the drive train between the drive motor and the ejector shaft include plastic parts, including the gear wheel and the vertical cam shaft, when rotation of the ice ejector shaft is interrupted by a jammed ice body, the larger powered drive motor can cause such high torque between the gear wheel and vertical cam shaft that fracture or breakage of the plastic drive components can result.

A further problem with such ice makers concerns the water fill cycle of the ice maker. To control operation of the water refill cycle, an electrical water fill contact of the control module will periodically contact a relatively moveable circumferential track of a face cam circuit mounted on the gear wheel. In order to selectively adjust the fill cycle time (and hence the water depth in the ice maker mold) the contact is radially positionable by means of an adjustment screw and the start up location is determined by an angled groove in the rotatable circuit track.

To establish the proper fill level, the adjustment screw for the water fill contact must be precisely set. This typically requires a multiplicity of assembly inspections and a water fill check procedure. Furthermore, after the contact position has been properly determined, shipping and handling of the ice maker, as well as subsequent installation in a refrigerator/freezer, can alter the radial position of the contact and hence cause unwanted changes in the water refill time. Moreover, since the contact adjustment screw can protrude from the device, it can impede packaging and be subject to breakage or damage during handling of the ice maker. Thus, while heretofore the adjustable positioning of the water refill contact relative to the gear contact track was intended to enable a precise fill level in the mold, it has resulted in uncertainty and water fill cycle problems in the field.

OBJECTS AND SUMMARY OF THE INVENTION

It is an object of the present invention to provide an ice maker having a drive control module that is simpler in design and more reliable in operation.

Another object is to provide an ice maker as characterized above which has an ice body ejector drive that is less susceptible to fracture or failure in the event of an ice cube jam during an ejection cycle.

A further object is to provide an ice maker of the foregoing type having a control module that can be assembled with the ice maker to precisely control the water fill cycle without factory testing.

Still another object is to provide an ice maker of the above kind that has a control module in which the water fill cycle is substantially unaffected by alterations in the radial position of a water fill control relative to a rotatable face cam circuit track of the control. Yet a further object is to provide such an ice maker in which the control module has a water fill contact the position of which is less susceptible to alternation during shipping and handling of the ice maker, or during installation in a refrigerator/freezer.

Other objects and advantages of the invention will become apparent upon reading the following detailed description and upon reference to the drawings, in which:

Figures 1, 2:
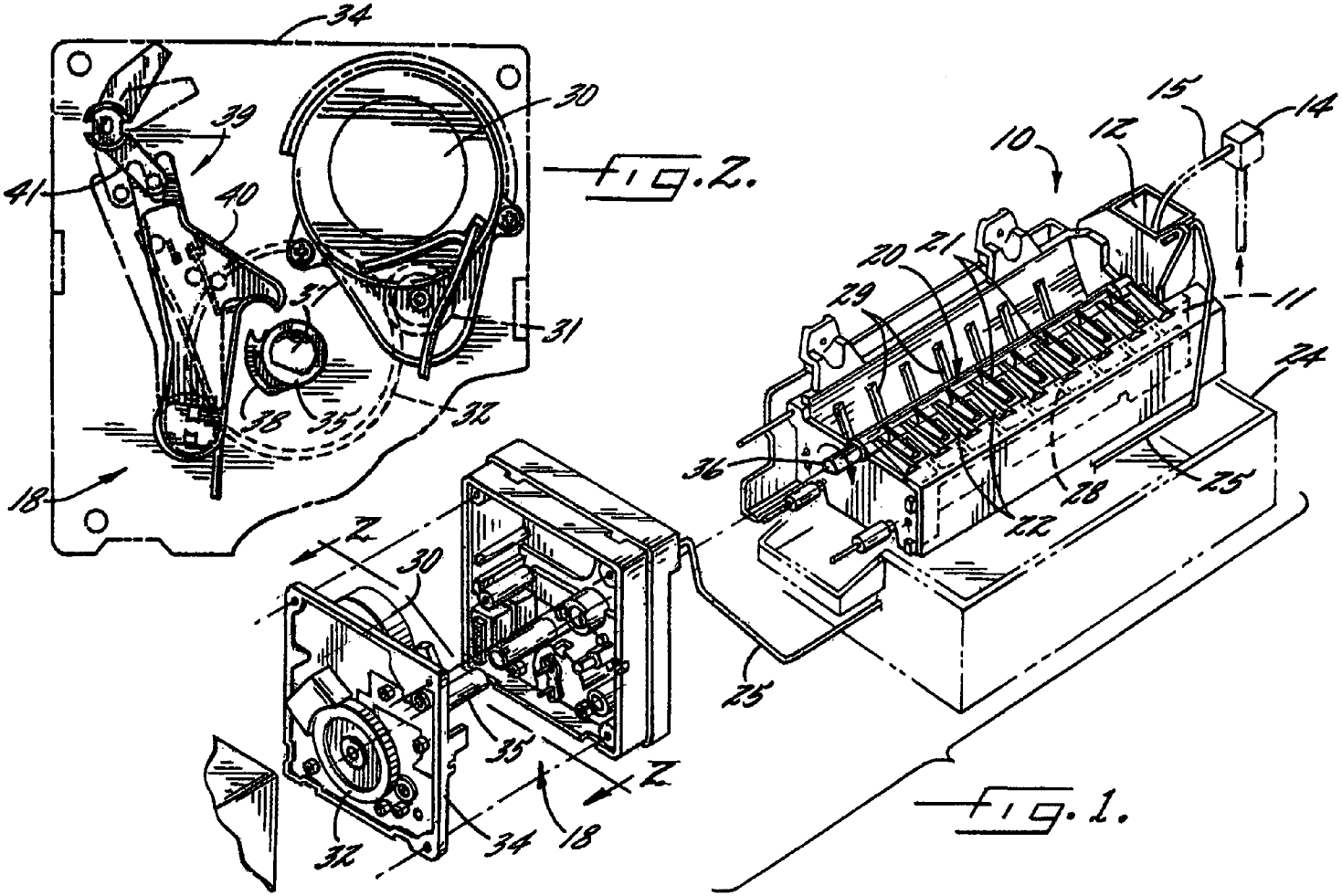
FIG. 1 is a fragmentary perspective of a refrigerator ice maker in accordance with the invention.
FIG. 2 is an enlarged fragmentary vertical section of the illustrated ice maker taken in the plane of line 2—2 in FIG. 1, with certain parts removed for clarity.
Figure 3:
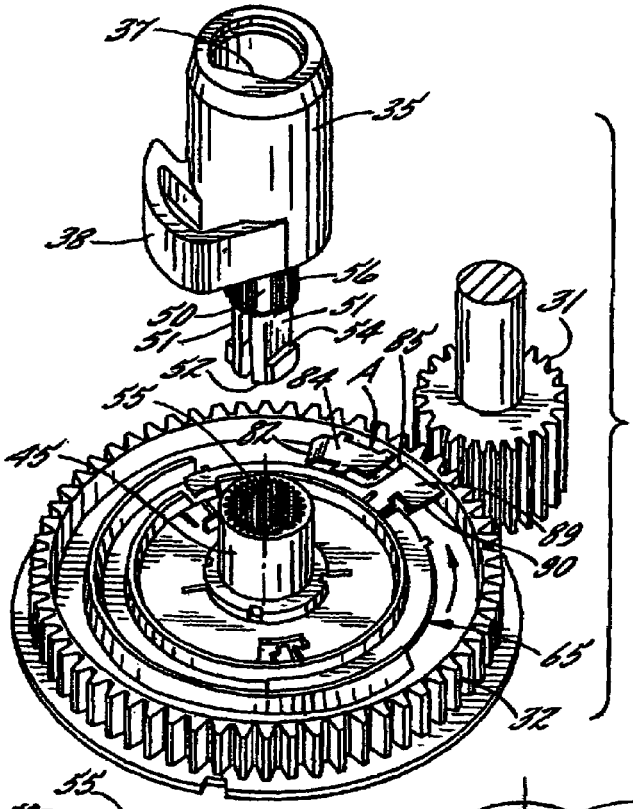
FIG. 3 is an enlarged exploded perspective of one embodiment of an ice ejector drive coupling in accordance with the invention.
Figure 3A:
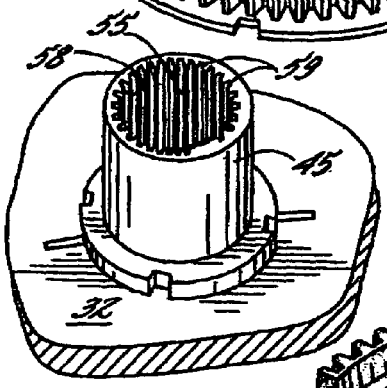
FIG. 3*a* is an enlarged fragmentary perspective of a drive sleeve of the gear wheel shown in FIG. 3.
Figure 4:
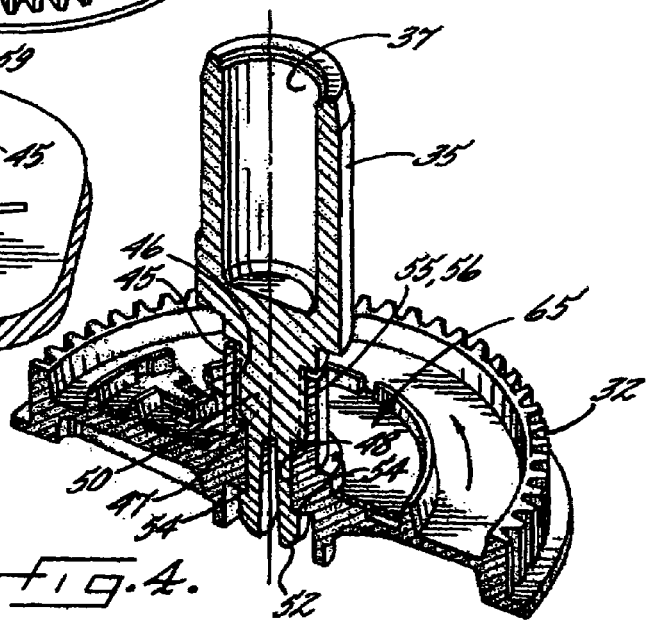
FIG. 4 is a sectioned perspective of the drive coupling shown in FIG. 3 in assembled condition.

While the invention is susceptible of various modifications and alternative constructions, certain illustrated embodiments thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE INVENTION

Referring now more particularly to FIG. 1 of the drawings, there is shown an illustrative ice maker 10 in accordance with the invention. It will be understood that the basic construction and operation of the ice maker is disclosed in the afore-referenced U.S. Pat. No. 5,261,248, the disclosure of which is incorporated herein by reference and need not be repeated in detail.

The illustrated ice maker, as depicted in FIG. 1, includes a mold 11 in which ice bodies are formed from water delivered to the mold 11 by a fill dispenser 12 fluidically connected to a solenoid valve 14 by a water supply line 15. The solenoid valve 14 in turn is connectable to a suitable pressurized water supply. The ice maker 10 further includes a control module 18 disposed at the front of the mold 11 and arranged to operate an ice ejector 20, which upon completion of a freezing cycle of water in the mold 11, removes the ice bodies from the mold. The ice ejector 20 has a plurality of radial ejector arms 21 that rotatably engage and carry ice out of the mold 11, which is stripped by strippers 22 and drop into an adjacent collecting bin 24. A pivotably mounted ice level sensing arm 25 extends downwardly above the collecting bin 24 to sense the level of ice bodies in the bin 24. The illustrated mold 20 includes a plurality of partition walls 28 extending transversely across the mold 20 to define a plurality of cavities in which a corresponding plurality of ice bodies are formed. The partition walls 28 may be formed with appropriate recesses 29 communicating between the cavities to permit the flow of water from cavity to cavity during a water fill cycle operation. It will be understood that removal of the ice bodies from the mold cavities may be facilitated by heating the underside of the mold 11 to free the ice bodies for ejection from the cavities by the ejector 20.

The control module 18 includes a motor 30 having an output pinion 31 that drives the periphery of a relatively larger gear wheel 32 mounted on a front side of a side plate 34 of the control module 18. The gear wheel 32 in turn drives a vertical cam shaft 35, which in turn drives a central shaft 36 of the ice ejector 20. The vertical cam shaft 35 in this case has a D-shaped opening 37 that receives the ice ejector shaft 36 for rotation therewith. The vertical cam shaft 35 carries a cam 38, referred to in the art as a vertical cam, having a cam surface that cooperates with a lever mechanism 39 for controlling positioning of the ice level sensing arm 25 in a conventional manner in response to rotation of the cam 38. The lever mechanism 39 in this case includes a lever arm 40 having a cam follower surface engageable with the cam 38 and being pivotal in response rotation of the cam shaft 35 for pivoting an actuator 41 to which the sensing arm 35 is fixed.

To reduce manufacturing costs, it is known to make various parts of the ice maker control module 18 of molded plastic, including the gear wheel 32, vertical cam shaft 35, level arm 40, and actuator 41. As indicated previously, in the event of an ice jam between the ejector arms 21 and the strippers 22 during an ice ejection cycle, large stresses can be imparted on the drive components by the drive motor 30 that can cause fracture or breakage of the plastic drive components, including particularly the gear wheel and/or cam shaft.

In accordance with one aspect of the invention, the drive gear and vertical cam shaft have a splined connection which more effectively distributes driving forces and substantially reduces the risk of fracture or part failure. In the illustrated embodiment, the gear wheel 32 has a central rearwardly extending sleeve 45 formed with an enlarged diameter cylindrical counter bore section 46 which defines an annular locating ledge 47, and which communicates with a smaller diameter bore 48 that extends through a forward side of the gear wheel 32. The vertical cam shaft 35 has a forward end that includes a cylindrical section 50 that is positionable within the cylindrical counter bore section 48 of the gear wheel-sleeve 45 and projecting locking legs 51 that extend forwardly through the central smaller diameter bore 48 of the gear wheel 32. The locking legs in this case have tapered end surfaces 52 for camming the legs 51 together during forceful insertion through the gear wheel bore 48 and outwardly directed locking ledges 54 for lockingly engaging a forward side of the gear wheel 32.

In keeping with the invention, the cylindrical counterbore section 46 of the gear wheel sleeve 45 and the cylindrical section 50 of the vertical cam shaft 35 are formed with longitudinally extending, circumferentially spaced splines 55, 56, respectively which are adapted for inter fitting, radial force transmitting engagement with each other. The splines 55, 56 in this case each have complimentary general V-shapes with peaks 58 and valleys 59 that may be rounded or squared. It will be understood that the splines 55, 56 of the gear wheel 32 and cam shaft 35 can be positioned longitudinally into assembled relation to each other for providing radial force transmission as an incident to operation of the drive motor 30 and rotation of the gear wheel 32. Indeed, the spline connection has been found to permit transmission of substantially greater torque, up to 30% or more, through the drive train without failure of plastic drive components. While the theory of operation is entirely understood, it is believed that the increased surface area attributed to the engaging splines 55, 56 minimizes the magnitude of transmitted stresses between the gear wheel and vertical cam shaft that occur during high torquing, such as during temporary jamming of ice body between the mold and ejector arms during an ejection cycle.

It will be understood that while in the illustrated embodiment the gear wheel 32 drives the cam shaft 35, which in turn is mechanically coupled to the ejector shaft 36 alternatively, the cam shaft 35 could be an integrated part of the ejector shaft 36. For purposes herein, reference to a shaft section being operatively coupled to the ejector shaft is intended to mean a shaft section that is mechanically coupled to the ejector shaft or integral therewith.

Figure 5:
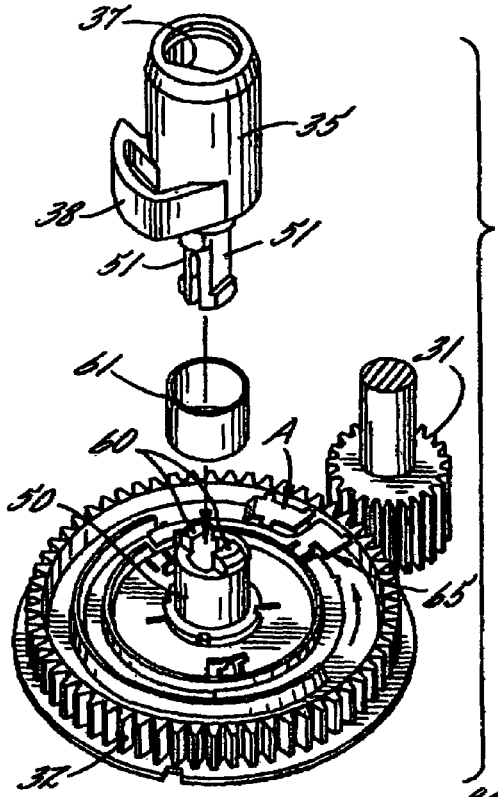
FIG. 5 is an exploded perspective of an alternative embodiment of ice ejector drive coupling in accordance with the invention.
Figure 6:
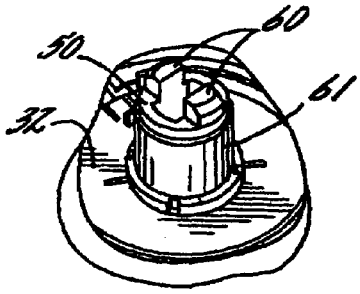
FIG. 6 is an enlarged fragmentary perspective of a drive sleeve of the gear wheel shown in FIG. 5.

An alternative embodiment of drive connection between the gear wheel 32 and vertical cam shaft 35 for improving torque transmission through the plastic drive components of the drive module 18 is shown in FIGS. 5 and 6, wherein items similar to those described above have been given similar reference numerals. In this embodiment, the vertical cam shaft 35 again has a pair of locking legs 51 that are positionable through a central bore of the gear wheel 32 into locking engagement with a forward side thereof. For transmitting torque between the gear wheel 32 and vertical cam shaft 35, in this case the cylindrical drive sleeve 50 of the gear wheel 32 is formed with a pair of diametrically opposed rearwardly extending drive lugs 60 at its end that are positionable into inter fitting relation with opposed recesses in an axial end face of the cam shaft 35 adjacent opposite sides of the locking legs 51. Upon assembly of the gear wheel 32 and cam shaft 35, it can be seen that the drive lugs 60 will transmit rotational torque to the cam shaft 32 as an incident to operation of the drive motor 30.

In carrying out this embodiment of the invention, an annular metal collar 61 is positionable in tight fitting relation about the cylindrical drive sleeve 50 of the gear wheel 32. The metal collar 61, which preferably is made of steel and press fit onto the gear wheel sleeve 50, unexpectedly has been found to enhance torque transmission between the gear wheel 32 and vertical cam shaft 35 without fracture or cracking of the plastic drive components. The metal collar 61 is believed to reinforce the drive connection and thereby permit substantially greater torque transmission without part failure.

In accordance with a further aspect of the invention, the plastic drive components of the drive module 18, and particularly the gear wheel 32 and vertical cam shaft 35, are formed of a stress resistant material that further enhances torque transmission through the drive module to the ejector 20 without cracking or other failure of the plastic parts. To this end, in the illustrated embodiment, the plastic drive components are made from a polyamide resin. The resin can be any suitable polyamide resin, but preferably the resin is a nylon resin. Suitable nylon resins include, but are not limited to, nylon 6 (e.g., polycaprolactam), nylon 6/6 (e.g., poly(hexamethylene adipamide)), and nylon 6/12, (e.g., poly(hexamethylene dodecanediamide)), copolymers thereof, and mixtures thereof. Preferably, the polyamide resin is nylon 6/6 (e.g., poly(hexamethylene adipamide)), which typically is made via the polycondensation of hexamethylene diamine and adipic acid. In order to further increase the mechanical strength of the polyamide resin from which the drive components are made, the polyamide resin preferably further comprises a reinforcing filler, such as glass fibers. The polyamide resin can comprise any suitable amount of reinforcing filler. For example, when the reinforcing filler is a glass fiber, the polyamide resin preferably comprises about 20% to about 30% (e.g., about 25%) by weight glass fiber based on the total weight of the resin and reinforcing filler. Suitable commercially available resin/filler blends include, but are not limited to, the nylon 6/6 resins marketed by DuPont under the trademark Zytel®, such as Zytel® FR50HF NC010 nylon 6/6 resin, and the nylon 6/6 resins marketed by Solutia under the trademark VYDYNE®, such as VYDYNE® 909 nylon 6/6 resin.

Figure 7:
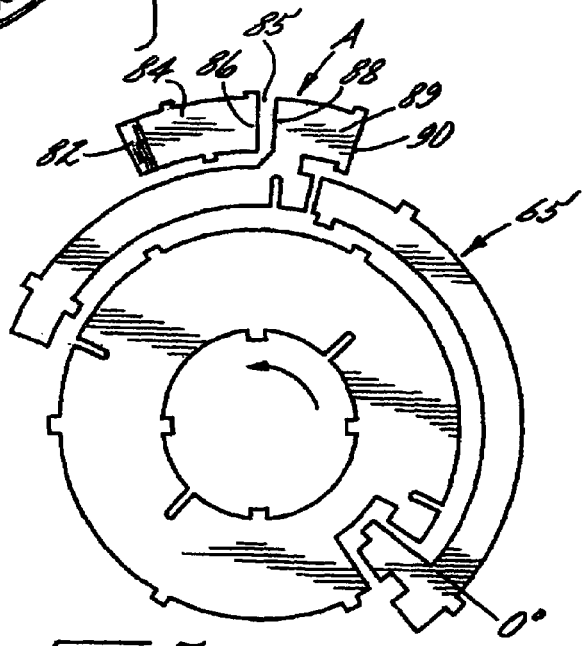
FIG. 7 is a side elevational view of a face cam electrical circuit of the control of the illustrated ice maker.
Figure 8:
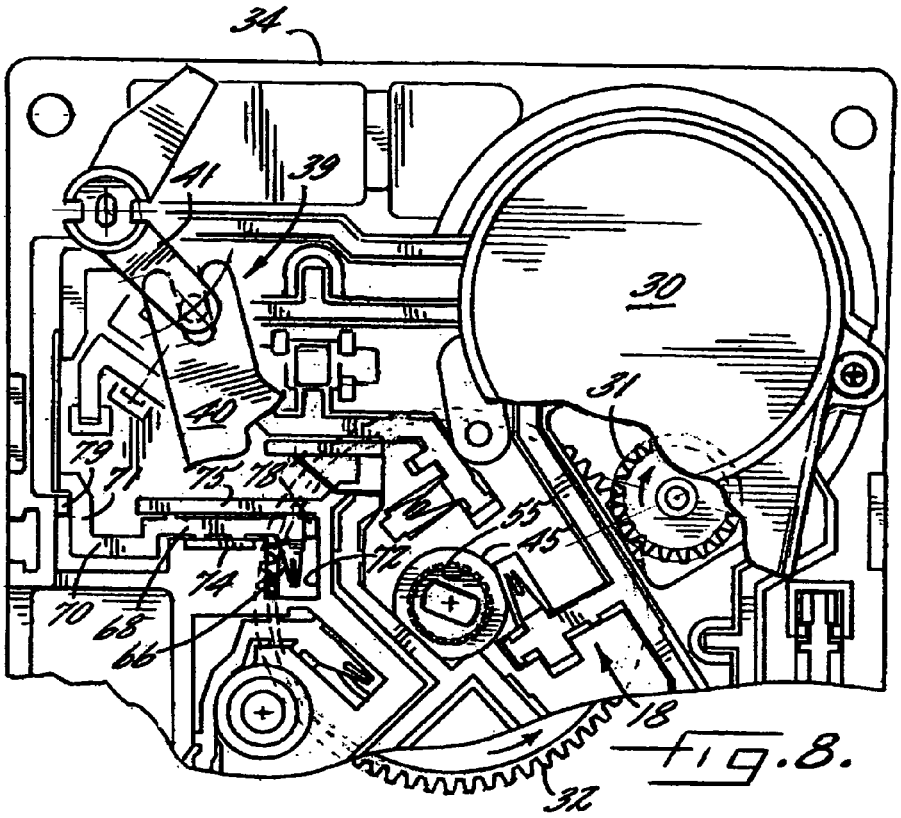
FIG. 8 is an enlarged fragmentary vertical section and side elevational view of a side plate of the control module of the illustrated ice maker, also taken in the plane of line 2—2 in FIG. 1, with certain parts removed for illustrating the electrical control.
Figure 9:
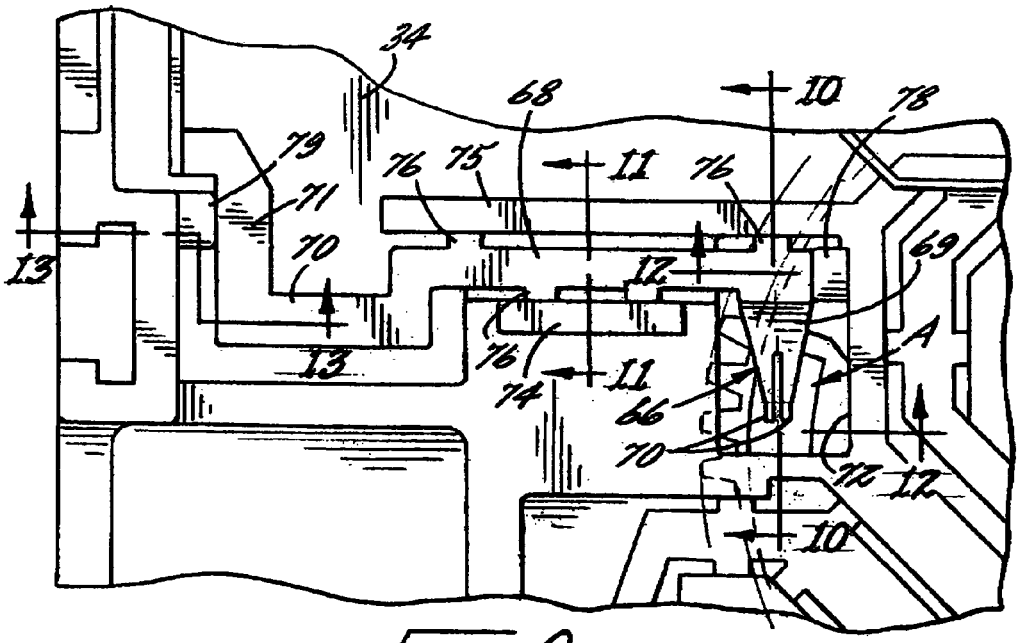
FIG. 9 is an enlarged side elevational view of the water fill contact shown in FIG. 8.
Figure 10:
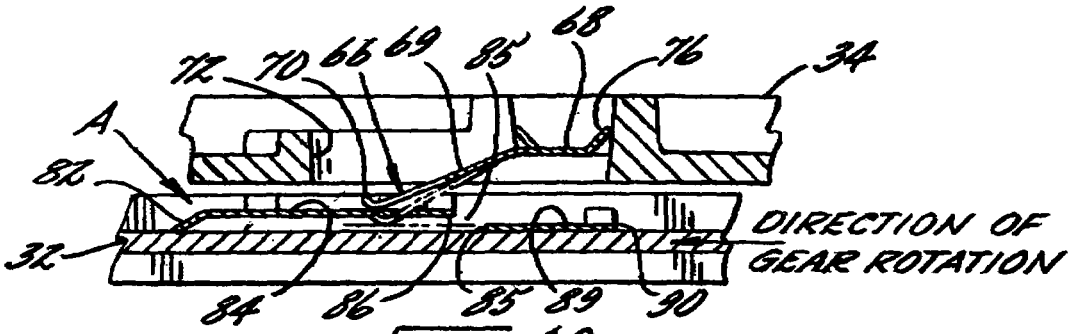
FIGS. 10–13 are enlarged fragmentary sections of the water fill contact and its mounting in the illustrated control, taken in the planes of line 10—10, 11—11, 12—12 and 13—13, respectively in FIG. 9.
Figure 11:
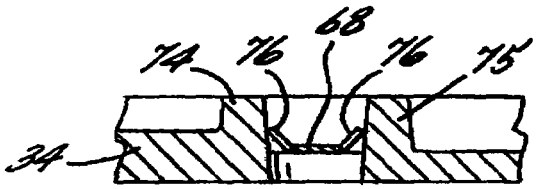
Figure 12:
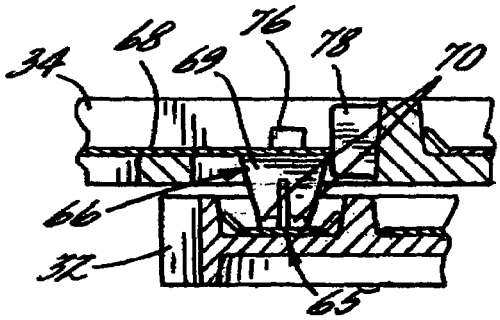
Figure 13:
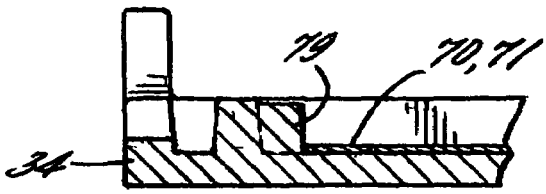

For controlling operation of electrically responsive functions of the ice maker 10, a face cam circuit 65 is mounted on a rear side of the gear wheel 32 of the control module 18. As known in the art, the face cam circuit 65, as depicted in FIG. 7, may define a plurality arcuate face cam circuit tracks of electrically conductive material. Rotation of the gear wheel 32 and face cam surface 65 in the counter-clockwise direction from a zero degree home position will sequentially move the arcuate tracks into electrical contact in relation with respective contacts mounted on the side plate 34 of the module 18 at radial positions corresponding to face cam circuit tracks for operating the electrically activated functions of the ice maker.

The water fill cycle of the illustrated ice maker 10 in which water is directed to the fill dispenser 12 for filling the compartments of the mold 11 is controlled by a track A of the face cam circuit 65. As an incident to operation of the drive motor 30 and rotation of the gear wheel 32, track A is movable into contact with a water fill contact 66. The face cam circuit track A in this case is the most radially outwardly disposed face cam circuit track, as is the water fill contact 66. Heretofore, as indicated above, it has been difficult to factory install such water fill contact for filling the mold cavities to a predetermined level without selective adjustable positioning of the water fill contact and factory testing of the water fill cycle. The setting of the water fill contact also can be altered during subsequent shipping, handling, or installation of the ice maker in a refrigerator/freezer resulting in unwanted changes in the water fill level.

In accordance with a further aspect of the invention, the face cam circuit track A and water fill contact 66 can be efficiently factory installed and assembled for establishing a predetermined water fill level in the mold and the water fill level will not be affected by slight alterations in the radial position of the water fill contact 66 during handling or shipping of the ice maker 10. The water fill contact 66 in this instance has a generally elongated configuration comprising a first elongated section 68 having a contact head 69 extending transversely in a direction parallel to the circumferential line of movement of the face cam circuit track A past the contact 66. The contact head 69 in this case has split fingers 70 that can be biased into engaging relation with the face cam circuit track A of an incident to circumferential movement of the face cam circuit A track passed the contact. Alternatively, it will be understood that the contact 66 can be in the form of a brush similarly oriented parallel to the line circumferential movement of the face cam circuit track. The illustrated water fill contact 66 in this case has a second elongated section 70 laterally offset from the first elongated section 68, with a transverse leg 71 at the end thereof that is electrically connected to the control circuitry for the ice maker in a known manner.

The illustrated water fill contact 66 is mounted in channel-like recesses in the rear side of the module side plate 34 with the contact head 69 extending through an opening 72 in the side plate 34 into adjacent relation to the rear side of the gear wheel 32. The first elongated section 68 of the water fill contact 66 is mountable in a channel recess defined by parallel walls 74, 75 and is formed with side wings 76 for biased engagement with the side walls 74, 75 for retaining the contact 66 in fixed relation between the walls. For retaining opposite longitudinal ends of the water fill contact 66, and hence the radial position of the contact head 69 relative to the face cam circuit track A, the side plate 34 is formed with ribs 78, 79 between which opposite elongated ends of the water fill contact 66 abut.

During operation of the ice maker drive motor 30 and rotation of the gear wheel 32 and face cam circuit 65 from the zero position shown in FIG. 7, the water fill contact head 66 will initially be disposed in closely spaced relation to the rear face of the gear wheel 32. Continued circumferential advancement of the face cam circuit track A will move and an inclined ramp 82 of an initial section 84 of the face cam circuit track A into engagement with the water fill contact 66 causing the fingers 70 of the contact head 69 to ride up the ramp 82 and be forced into biased engaging relation with the initial section 84 of the face cam circuit track A. Since in the illustrated embodiment, the initial section 84 of the face cam circuit track A is not electrically connected to the control circuitry for the ice maker 10, it serves only to raise and bias the contact head finger 70 into sliding engagement with the track.

Continued circumferential movement of the cam face circuit track A will cause a gap 85 defined between a trailing edge 86 of the initial track section 84 of the face cam circuit track A and a leading edge 88 of a further operative section 89 of the face cam circuit track A to move under the water fill contact head 66, with the edges 86, 88 defined by the gap 85 cleaning any foreign matter that may have accumulated on the contact fingers 70. Engagement of the leading edge 88 of the operative section 89 of the face cam circuit track A with the water fill contact 66 will close an electrical circuit effective for energizing and opening the solenoid water supply valve 14. The water supply valve 14 remains open during the period of circumferential movement of the operative section 89 of the face cam circuit track A passed the water fill contact 66 and is closed by de-enerization of the solenoid valve 14 when a trailing edge 90 of the operative section 89 of the face cam circuit track A circumferentially passes beyond the water fill contact 66.

In keeping with the invention, the leading and trailing edges 88, 90 of the operative section 89 of the face cam circuit track A are designed such that a constant predetermined refill cycle is effected notwithstanding slight alteration in the radial position of the water fill contact head 69 relative to the face cam circuit track A through longitudinal movement of the water fill contact elongated sections 68–70, such as can occur by reason manufacturing tolerances in the contact retaining ribs 78, 79 or forces to which the contact may be exposed during shipping/handling or installation of the ice maker. To this end, the leading and trailing edges of the operative section 89 of the face cam circuit track A are radially oriented with respect to the axis of rotation of the gear wheel and face cam circuit 65 such that regardless of slight changes in the radial position of the water fill contact head 69 the water fill time remains constant and unaffected. By reason of the radial orientation of the leading and trailing edges 88, 90 of the face cam circuit track A, which can be formed with close tolerances, the water fill contact 66 and face cam circuit 65 can be factory installed efficiently without tedious and time consuming assembly and test procedures. Moreover, since the water fill time, hence the water level in the mold, is governed entirely by the location of the leading and trailing radial edges 88, 90 of the face cam circuit track A the mold can be filled to the same predetermined water level during each fill cycle not withstanding slight alterations in radial positioning of the water fill contact during assembly or handling of the ice maker.

From the foregoing, it can be seen that an ice maker is provided that has a drive control module that is simpler in design and more reliable in operation. The module has an ice ejector drive that is less susceptible to fracture or failure in the event of an ice cube jam during the injection cycle, and the control module is operable for refilling the ice maker mold to the same predetermined level notwithstanding alterations in positioning of a water fill switching contacts due to manufacturing tolerances or forces to which the ice maker is subjected during shipping, handling or installation.

What is claimed is:

1. An ice maker comprising:

a mold in which water is frozen to form ice bodies;

a rotatable ejector having a central ejector shaft and plurality of radial arms for ejecting ice bodies from said mold;

a drive for rotatably driving said ice ejector, said drive including a drive motor and a gear wheel rotatably driven by said drive motor;

a drive coupling between said gear wheel and ejector shaft that includes a bore formed in a sleeve in said gear wheel, said sleeve extending outwardly to one side of said gear wheel and shaft section coaxial with said gear wheel, said bore being formed with a plurality of internal circumferentially spaced longitudinal splines, and said shaft section being formed with a plurality of external circumferentially spaced longitudinal splines complimentary to the splines of said bore such that said splined shaft section is positionable within said splined bore with said splines of said bore and shaft section effecting rotary torque transmission therebetween; and said shaft section having a pair of locking legs that extend from one end of the shaft section through said bore into engaging relation with a side of said gear wheel and being operatively coupled to said ejector shaft.

2. The ice maker of claim 1 in which said gear wheel and shaft section are made of plastic.

3. The ice maker of claim 1 including a storage container for storing ice bodies ejected from said mold, a sensing arm having a free end for sensing the level of ice in said storage container, said shaft section is a cam shaft separate from said ejector shaft, said cam shaft having a vertical cam for actuating movement of said sensing arm, said cam shaft having said shaft section splines adjacent one end and being mechanically connected in coaxial relation to the ejector shaft at its other end for transmitting torque therebetween.

4. The ice maker of claim 3 in which said gear wheel and cam shaft are made of plastic.

5. The ice maker of claim 1 in which the splines of said bore are formed in a counter bore of said sleeve, said counter bore communicating with a smaller diameter bore extending centrally through said gear wheel, and said shaft section having a pair of locking legs that extend through said smaller diameter bore into snap action locking engagement with a side of said gear wheel.

6. The ice maker of claim 5 in which said locking legs extend from one axial end of said claim shaft and an opposite axial end of said cam shaft is formed with an opening for receiving an end of said ejector shaft and transmitting driving torque thereto.

7. The ice maker of claim 1 in which said drive motor has a drive pinion for operatively engaging and driving an outer perimeter of said gear wheel, and said gear wheel carries arcuate electrical face circuit tracks for controlling electrically responsive functions of the ice maker.

8. An ice maker comprising, a mold in which water is frozen to form ice bodies;

a rotatable ejector having a central ejector shaft and plurality of radial arms for ejecting ice bodies from said mold;

a drive for rotatably driving said ice ejector, said drive including a drive motor and a plastic gear wheel rotatably driven by said drive motor;

a drive coupling between said gear wheel and ejector shaft that includes a bore and a shaft section, said shaft section having an end that is positionable into said bore and mechanically coupled thereto for transmitting torque therebetween as an incident to rotary driven movement of said gear wheel, and said gear wheel and shaft section having a fracture resistant container being comprised of a polyamide resin; and a storage container for storing ice bodies ejected from said mold, a sensing arm having a free end for sensing the level of ice in said storage container, and said shaft section is a cam shaft separate from said ejector shaft, said cam shaft having a vertical cam for actuating movement of said sensing arm, said cam shaft having an end positionable into said bore and an opposite end mechanically coupled in coaxial relation to said ejector shaft for transmitting torque therebetween.

9. The ice maker of claim 8 wherein the polyamide resin comprises a nylon selected from the group consisting of nylon 6, nylon 6/6, nylon 6/12, copolymers thereof, and mixtures thereof.

10. The ice maker of claim 9 wherein the polyamide resin comprises nylon 6/6.

11. The ice maker of claim 10 wherein the polyamide resin further comprises a reinforcing filler.

12. The ice maker of claim 11 wherein the reinforcing filler comprises glass fibers.

13. The ice maker of claim 12 wherein the polyamide resin comprises about 20 to about 30% by weight glass fiber based on the total weight of the resin and reinforcing filler.

14. The ice maker of claim 8 wherein the polyamide resin further comprises a reinforcing filler.

15. The ice maker of claim 14 wherein the reinforcing filler comprises glass fibers.

16. The ice maker of claim 15 wherein the polyamide resin comprises about 20 to about 30% by weight glass fiber based on the total weight of the resin and reinforcing filler.

17. The ice maker of claim 8 in which said bore is formed with a plurality of internal circumferentially spaced longitudinal splines, and said shaft section is formed with a plurality of external circumferentially spaced longitudinal splines complimentary to the splines of said bore such that said splined shaft section is positionable within said splined bore with said splines of said bore and shaft section effecting rotary torque transmission therebetween.

18. The ice maker of claim 17 in which said splined bore is formed in a sleeve of said gear wheel extending outwardly to one side of said gear wheel.

19. The ice maker of claim 8 in which said bore is formed in a sleeve, said shaft section having an end positionable into said sleeve and mechanically coupled thereto for transmitting torque therebetween as an incident to rotary driven movement of said gear wheel, and a metallic collar positionable in tight fitting relation over said sleeve for enhancing torque transmission through said drive coupling without damage to said sleeve and shaft section.

20. The ice maker of claim 19 in which said sleeve is integrally formed on said gear wheel.

* * * * *